US005193725A

United States Patent [19]

Radocy

[11] Patent Number: 5,193,725

[45] Date of Patent: Mar. 16, 1993

[54] ADJUSTABLE QUIVER MOUNT

[76] Inventor: Robert Radocy, 1280 28th St., Ste. 3, Boulder, Colo. 80303-1797

[21] Appl. No.: 707,851

[22] Filed: May 30, 1991

[51] Int. Cl.[5] ..... A45F 5/00

[52] U.S. Cl. ..... 224/197; 224/200; 224/253; 224/916

[58] Field of Search ..... 224/916, 197, 198, 199, 224/200, 253, 271, 272

[56] References Cited

U.S. PATENT DOCUMENTS

| | | | |
|---|---|---|---|
| 2,908,432 | 10/1959 | Kent . | |
| 3,017,874 | 1/1962 | Gubash . | |
| 3,434,638 | 3/1969 | Beynon | 224/197 |
| 4,156,496 | 5/1979 | Stinson . | |
| 4,252,101 | 2/1981 | Spitzke . | |
| 4,363,312 | 12/1982 | Spitzke . | |
| 4,883,290 | 11/1989 | Landa | 224/197 |

*Primary Examiner*—Linda J. Sholl
*Attorney, Agent, or Firm*—James E. Pittenger

[57] ABSTRACT

An improved archery quiver mounting device is provided which includes a base support member and a quiver mounting arm. The base support member includes an attaching arrangement for attaching the mounting device to the belt or waistband of the archer. In addition, a clevis device having bifurcated legs is provided for pivotally receiving the quiver mounting arm. The mounting arm has an aperture to receive a tension adjusting bolt which has a convenient hand knob for quickly adjusting the friction between the clevis parts and the mounting arm so that the mounting arm can be positionally adjusted in any desired position. The opposite end of the mounting arm has a number of properly placed mounting holes for attaching the coupler flange for a standard quiver mount whereby a quiver can be quickly and easily attached to the arm. The mounting arm can be bent inwardly toward the leg of the archer so as to properly position the quiver during use.

12 Claims, 3 Drawing Sheets

ADJUSTABLE QUIVER MOUNT

FIELD OF THE INVENTION

This invention is directed to an archer's quiver mount, which allows adjustable positioning of the quiver during use. It is more specifically directed to a mount attachable to the waist of the archer and which allows the quiver and arrows to be adjusted by one hand to various secure angular positions during use.

BACKGROUND OF THE INVENTION

The archery quiver has been described as a container for conveniently carrying and storing arrows for use by an archer. The quiver is a handy tool which allows the archer to have convenient access to the arrows during various archery events. These events not only cover recreational shooting, but tournament competition as well as use during bow hunting.

As is well understood the position of the quiver during hunting can become quite critical to the hunter. Arrows are long, thin projectiles that have stabilizing feathers or vanes at one end and a sharpened tip or point at the opposite end. A notch, provided at the feathered end, allows the arrow to engage the bow string to stabilize the arrow and provide direct energy transfer from the bow string to the arrow at the time that the arrow is released.

Most quivers are arranged so that the pointed end of the arrow is inserted into the quiver to protect the points and hold or retain the arrows. Thus, the feathered or "nock" end of the arrow extends usually beyond the quiver in an exposed manner. These feathers or vanes are usually colorful and quite visible so that the archer can track the arrow in flight and identify its position in the target. In many cases, whether the user is engaged in competition or hunting determines the type of quiver and the mounting arrangement for the quiver. In the past the hunting quivers have been mounted on the back of the user by means of a strap or have been hung by a strap from the belt or waistband of the user. In many cases where the belt has been used as the support for the quiver a second strap at the bottom of the quiver has been tied to the leg to hold and position the quiver during ambulation. A third quiver mount which has become quite popular with competition archers as well as hunters is the arrangement where the quiver is mounted directly on the archer's bow From a patenting standpoint the first "bow" quiver was patented in the United States in 1949, by F. B. Bear (U.S. Pat. No. 2,464,068). This quiver was a unique approach to the sport of archery, since it secured arrows individually, rather than clustering them together and more significantly the quiver mounted directly onto the bow itself. Another quiver design patented in the United States in the same year, by J. A. Schoenike (U.S. Pat. No. 2,464,101), also held arrows individually in custom sized channels but maintained the traditional pouch design and was carried separate from the bow.

During following years numerous other "bow" quiver designs followed, which greatly broadened the original concept. Many of these quivers could be mounted at various angles to accommodate the archer's preference with regard to shooting position In addition, these developments included new mechanical arrangements for attaching and mounting the quivers to the bow as well as the person of the archer. Many of these included quick disconnect type methods, which allowed the quiver to be attached and removed quite readily in order to replenish the arrow supply of the archer. As an additional feature a patent by H. J. Rose, 1973, (U.S. Pat. No. 3,777,734) incorporated into the bow quiver a mounting element for use in attaching the quiver to the belt of an archer after detaching it from the bow.

Modern arrow quivers fall into three (3) categories; back quivers, bow quivers and hip quivers. All bow quivers hold arrows secured individually, but back and hip quivers can exhibit either type of arrow carrying design, such as, those which cluster arrows together or those which secure arrows individually. Existing designs in hip quivers, which secure arrows individually, are carried upon a waist belt, usually disconnect from the belt quickly and have a rigid spine design, which holds the arrows at a specific angle with relation to the belt support, as well as the ground. Most of these quivers have leg straps or ties to stabilize the lower portion of the quiver to the adjacent leg. Some of these designs even have a continuously pivoting yoke at the waist attachment which is provided to relive the torquing forces at the attachment due to walking or squatting, which are created during use. This is typical of the type of quiver which is mounted both at the waist as well as being tied to the leg, simultaneously.

The many prior art designs which presently exist with hip quivers which are preferred by hunters limit the bowhunter's ability to deal with varying terrain and to remain concealed, and camouflaged with the environment. A rigid fixed angle at which the arrows are held prohibits the archer from squatting against a steep hillside or among underbrush since the feathered or "nock" ends of the arrows will jam into and engage the surrounding terrain and foliage. Furthermore, should the archer need to crawl on "all fours", such quivers position the arrows so that the feathers or vanes extend high above the archers back, which is a decided detriment to his intended goal of concealment and camouflage. In addition, if the quiver is also attached to the leg of the archer this feature causes the feathered ends of the arrows to "flag" or wave while moving or ambulating which is again a decided detriment to the goal of the hunter.

INFORMATION DISCLOSURE STATEMENT

The following information is provided with respect to the duty of the applicant to disclose all information which is believed pertinent to the examination of this application. The following patents are provided in addition to the patents which have been previously mentioned in the prior art portion of this application.

The patents to Stinson (U.S. Pat. No. 4,156,496); Spitzke (U.S. Pat. No. 4,252,101); and Spitzke (U.S. Pat. No. 4,363,312) are typical of the many bow mounted quiver arrangements which have been previously disclosed in U.S. patents. These patents specifically teach quick disconnect mounting arrangements which allow the quiver to be removed or installed on the bow in a quick manner. Most of these patents utilize a slidable mounting coupler with the receiving portion fixably attached to the bow handle. It is a simple matter to slidably attach the quiver to the bow mount of conveniently positioning the arrows.

The Kent patent (U.S. Pat. No. 2,908,432) provides a convenient mounting arrangement for mounting a quiver onto the hip pocket of the archer. A U-shaped pocket plate is provided to be slidably inserted into the pocket for attachment. The quiver itself is fixedly attached at a specific angle to the pocket plate to hold the arrows in a fixed position.

The Gubash patent (U.S. Pat. No. 3,017,874) is an apparatus for pivotally mounting a quiver on a bow. This arrangement allows the arrows to be repositioned from a position where the arrows are parallel to the bow to a position where they are perpendicular. As the arrows are removed the mount rotates to reposition the next arrow. This arrangement is primarily intended for allowing a hunter to rapidly fire the arrows.

SUMMARY OF THE INVENTION

The present invention is intended as a quick-connect mount for hip mounted quivers. A base support member is provided which attaches to the belt of the user or can be inserted behind the waistband of the user's garment. The quiver mount of the present invention can be quite broad and curved to fit the contour of the user's hip, so as to provide a stable base or platform for the mounting of the quiver. A pair of bifurcated or forked relatively wide, flat legs, are provided and arranged parallel to the plane of the base support member. A slotted area having parallel sides is provided between the legs of the support member and is arranged to receive a quiver mounting arm with a tensioning, pivot bolt arranged to pass through the base legs and the mounting arm to hold the arm in position with respect to the slotted base. An easily gripped adjusting knob is mounted on the end of the pivot bolt so that adjustable tension force can be applied to the base legs to precisely adjust the rotational friction between the legs and the mounting arm so that the quiver can be easily pivoted to any desired angular position where it will stay until repositioned. While throughout this application it is disclosed that the quiver position can be easily changed or moved, it is also to be understood that the mounting arm can be essentially locked in position by increasing the tension with the knob so that the arm can not be moved without loosening the knob to reduce the frictional forces between the parts.

The opposite end of the mounting arm is angled inwardly towards the leg of the user to properly position the quiver close to the leg. A plurality of properly spaced mounting holes can be provided near the end of the mounting arm to receive a quick connecting flange or adaptor for releasibly attaching a quiver directly to the arm.

Any desirable material can be used in the fabrication of the base support member or the mounting arm, such as; light weight metal, plastics or synthetic resins. These items can be molded or machined as desired depending upon the manufacturing techniques used. Although the base support member and mounting arm can be fabricated from the same material it is probable more desirable to fashion at least one of these parts from a material such as high density polyethylene which has a relatively high lubricity to allow the parts to easily pivot with respect to the other. By the same token, the parts must have sufficient rigidity to adequately mount and support the quiver in the desired adjusted position.

One of the important features of the present invention is the positioning of the base support member so that the pivot of the mounting arm is essentially aligned with the hip joint of the archer. This allows the quiver to be mounted in a desired position so that the quiver will remain essentially motionless while the user is crawling, moving or stalking the prey. In the present arrangement only one hand is necessary to adjust the tension on the mounting arm and quickly change the quiver position when desired.

DETAILED DESCRIPTION OF THE INVENTION

Figure 1:
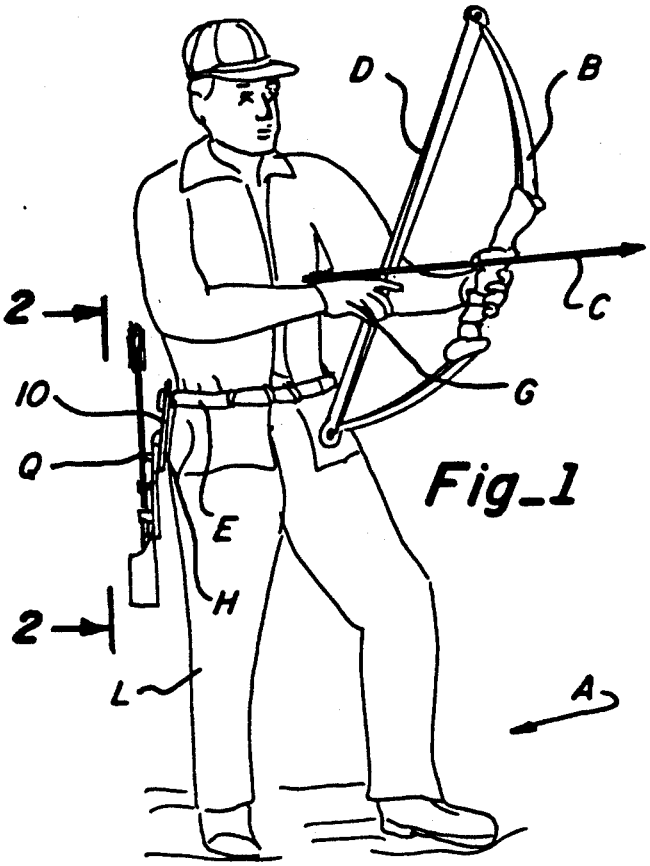
FIG. 1 is a pictorial view showing a archer with an arrow quiver held in proper hip position by the quiver mounting device of the present invention.

Turning now more specifically to the drawings, FIG. 1 shows an archer or bowman A holding a conventional bow B placing an arrow C in the bow string D. A quiver Q, usually of the quick mount type, is attached to the improved quiver mounting device 10 which in turn is attached to the waistband or belt E of the archer A. The quiver mounting device 10 according to the present invention is positioned usually at the side of the archer A adjacent to the hip area H so that the arrows are conveniently positioned close to the hand G of the archer A.

Figure 2:
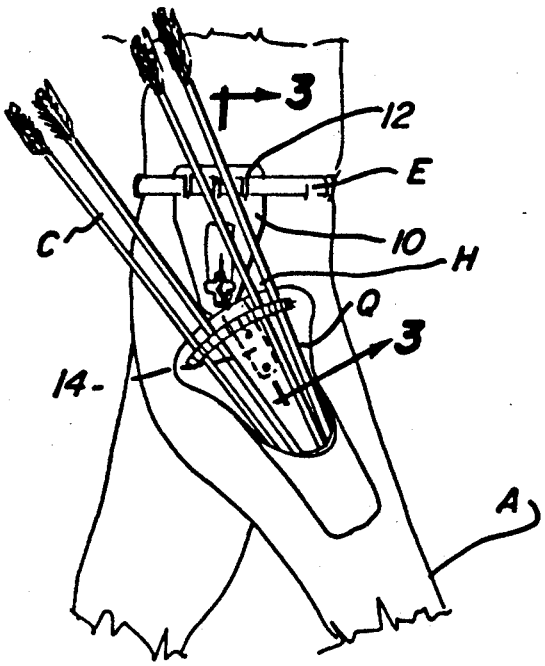
FIG. 2 is a pictorial side view taken along lines 2—2 of FIG. 1 showing the relative position of quivers and arrows with respect to the archer's body.

FIG. 2 shows the adjustable position of the quiver Q and arrows C positioned with respect to the base support member 12 of the mounting device 10. The angular position of the mounting arm 14 with respect to the base support member 12 conveniently positions the arrows C while the archer A is ambulating, crawling or stalking a prey. The angular position of the quiver Q with respect to the body of the user can be conveniently and quickly adjusted by one hand of the archer. This provides a unique and novel arrangement for carrying arrows either during recreational and tournament archery or bow hunting for wild game.

Figure 3:
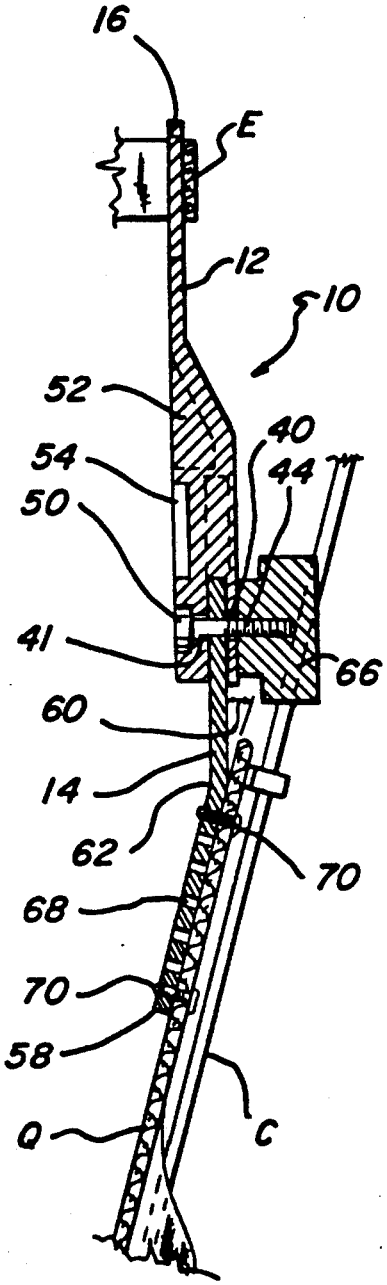
FIG. 3 is a cross-sectional view taken along lines 3—3 of FIG. 2.

FIG. 3 conveniently shows the base support member 12 of the mounting device 10 pivotally attached to the mounting arm 14. In addition, the overall relationship of the individual parts forming the mounting device 10 can be easily observed in FIG. 4.

Figure 4:
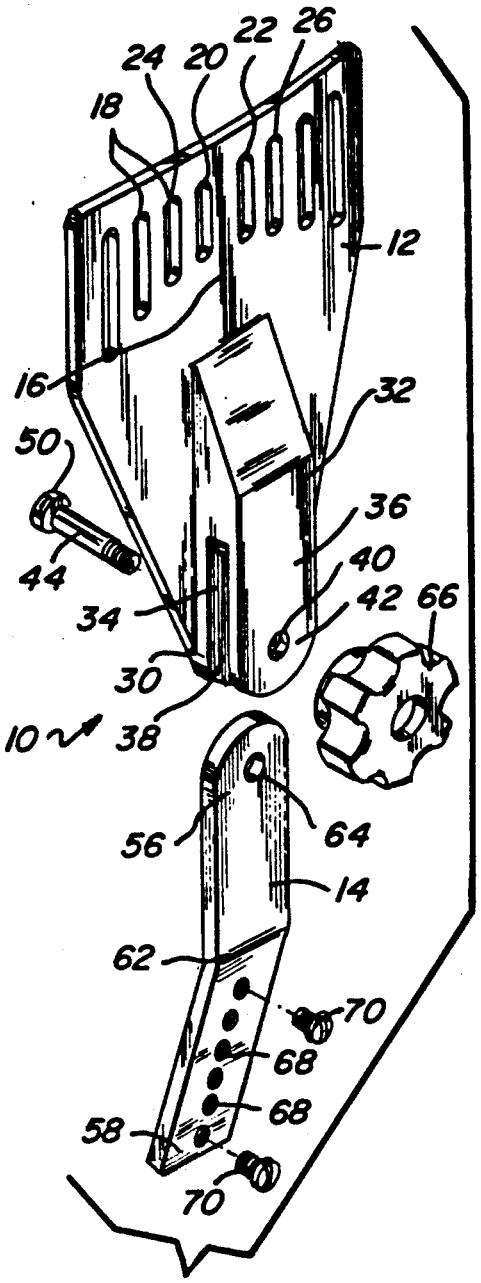
FIG. 4 is a pictorial assembly view of the parts making up the invention.
Figure 5:
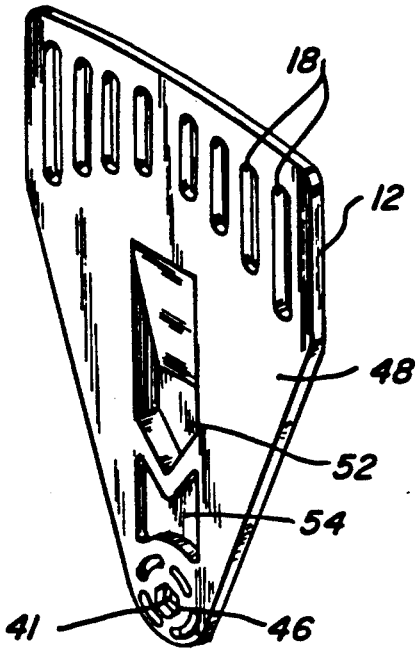
FIG. 5 is a perspective rear view of the base support member.
Figure 6:
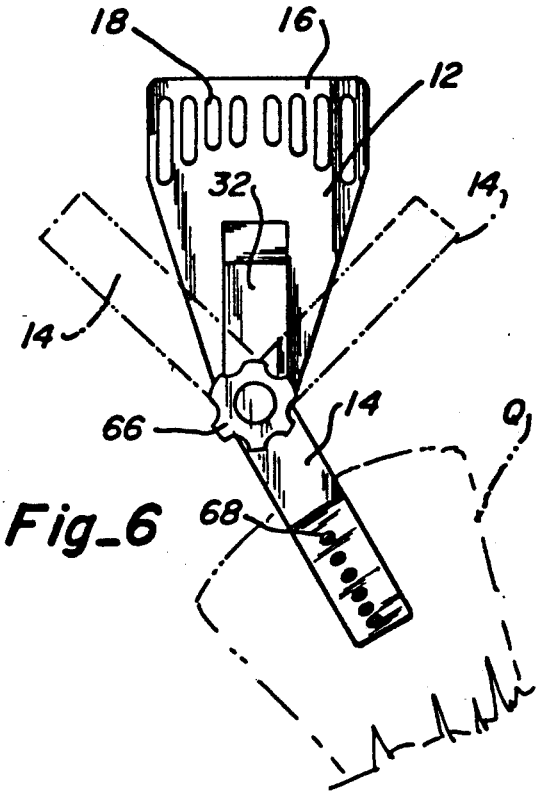
FIG. 6 is a pictorial front view of the mounting device showing the full pivotal range of the mounting arm.
Figure 7A:
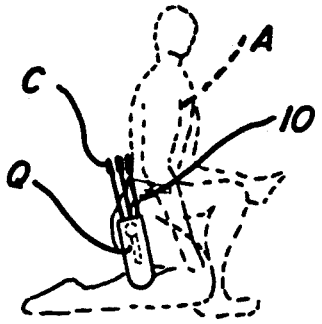
FIGS. 7A-7G shows various positions of the hip mounted quiver according to the present invention with respect to the various body positions of the archer.
Figure 7B:
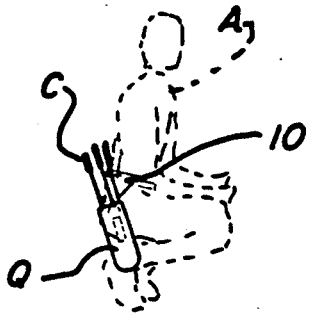
Figure 7C:
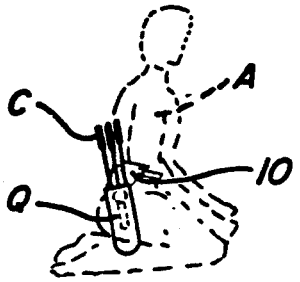
Figure 7D:
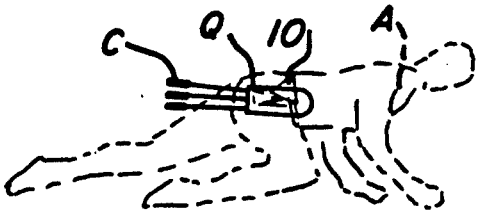
Figure 7E:
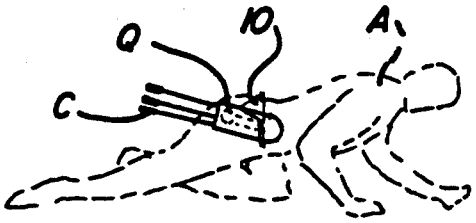
Figure 7F:
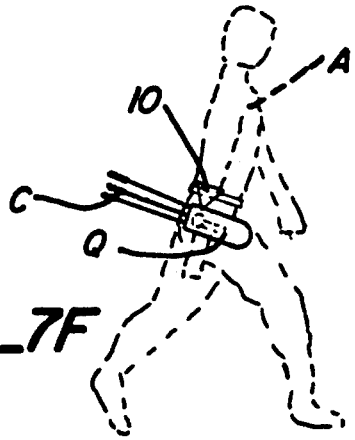
Figure 7G:
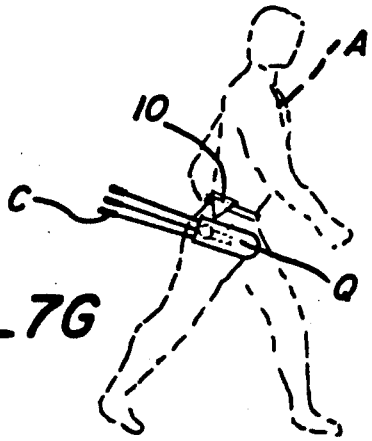

The base support member 12 has a rather broad attaching end 16 which can include any kind of arrangement for attaching the base support member 12 to the belt, trouser waistband, etc. of the user. A series of closed or open, parallel slots 18 having variable lengths can be provided in the attaching end 16 to easily and quickly attach the base support member to a belt having any conventional width. As can be seen in FIG. 4 it is possible to pair the slots 18 as far as length is concerned and to pair these slots on either side of the center line of the base support member 12. This is to say that slots 20, 22 can be paired and have the same length while at the same time slots 24, 26 can be paired and have the same length. The other slots 18 can also be so sized and arranged in a similar arrangement. In addition to an attaching means the attaching end 16 of the base support member 12 can also be curved slightly to fit the contour of the hip of the user. Although they are not mandatory, the provision of the plurality of belt slots 18 can also add additional flexibility to the base support member to assist in the curvature of the member during use to fit the hip contour. All of this provides a stabilized platform for the base support member with respect to the user's body for holding and supporting the mounted quiver in the desired position.

Although the actual shape of the base support member 12 is not critical in the preferred embodiment, the base support member has a triangular shape with the sides tapering from the attaching end 16 to a relatively narrow width at the opposite end 30. A clevis connector 32 is formed on the outer surface of the base support member 12 with the end of the clevis substantially aligned with the narrow end 30. The clevis connector 32 can be formed as a separate piece and attached to the surface of the base support member 12 or can be integrally formed as part of the base support member. The clevis 32 has bifurcated or forked legs 34, 36 forming a slotted opening 38. The facing surfaces of the legs 34, 36 making up the slotted opening 38 are relatively smooth and ar substantially parallel. A pair of aligned apertures 40, 41 is formed near the outer ends of both of the legs 34, 36. A bolt 44 having a proper diameter is arranged to pass through the apertures 40, 41. The back surface of the arm 34 which could actually be the back surface of the base support member 12 can have a hexagonal recess or cutout 46 which will fit the head 50 of the bolt 44. The recess 46 holds the bolt to prevent it from rotating during adjustment of the quiver position. In addition, cavities 52, 54 can be molded or machined into the back surface 48 of the base support 12 in order to reduce the weight of the overall component without sacrificing strength.

The quiver mounting arm 14 is a rather elongated rectangular member having a first end 56 which can be rounded and a second end 58 which can be squared. The width of the arm 14 can be the same general width as the clevis legs 34, 36. The quiver mounting arm can be slightly bent at approximately its mid-section 62 to form a shallow angle 60. The angle 60 can be formed to approximately 15 to 17 degrees with an angle of 16.5 degrees found to be acceptable. Since the mounting device 10 is intended to be used in a substantial vertical position the outer or second end 58 of the arm 14 will angle backwardly towards the leg of the user to properly position the quiver. A series of spaced and threaded holes 68 are provided along the center line of the outer end 58 of the arm 14. These holes are positioned, sized and threaded to comply with the standards of the Archery Manufactures Organization (AMO) to receive the standard quiver mounting connector. The angle 60 of the arm 14 and the number of holes 68 provided on the arm can be varied as needed to allow a variety of quiver quick-disconnect flanges or sleeves to be attached to the arm. These flanges or sleeves can be part of the conventional mount for attaching the quiver to the bow or some other quiver support or holder. In this way the quiver mounting device 10 provided by the present invention can be used with most any quiver which is available on the market.

The thickness of the mounting arm 14 is arranged so that it is the same or slightly less than the width of the slot 38 provided between the legs 34, 36 as provided in the clevis 32. A pivot aperture 64 is provided in the first end 56 of the arm 14. In use the arm 14 is inserted in the open slot 38 and the bolt 44 is passed through the apertures 40, 41 and through the aperture 64 provided in the arm 14. The hand knob 66 is threaded on to the end of the bolt 44 with the bolt head 50 seated within the recess 46 provided in the base support member 12. A small amount of flexure is provided in the leg 36 so that as the knob 66 is tightened, a frictional holding force is applied to the surfaces on both sides of the arm 14. The surface contact areas in conjunction with the coefficient of friction between the parts essentially allows the mounting arm 14 to be easily moved and repositioned with very little torque applied to the knob 66. In addition, movement of the arm 14 does not transmit forces to the knob 66 and thus the tension in the bolt and the rotational friction between the parts remains constant until readjusted manually. In this way it is very easy to adjustably control the friction forces between the parts whereby the quiver can be smoothly and easily pivoted into any desired position. In addition, because static friction forces are higher, the arm and the quiver will remain in the selected position until repositioned. The knob does not need to be turned nor the tension adjusted until the conditions change i.e. the quiver is replaced or arrows are added or removed from the quiver.

When the new and improved quiver mounting device is utilized it stabilizes and balances the quiver and arrows to minimize movement of the arrows while ambulating, stalking, shooting, hunting, etc. without having to attach the quiver directly to the archer's leg. In this way the archer is able to minimize the profile of the mounted quiver and arrows to reduce the overall exposure of the arrows and quiver to the elements such as trees, bushes and underbrush which have a tendency to snag and interfere with the movements of the archer.

One important feature of the quiver mounting device as described in the present invention is the intent to size the length of the base support member 12 so as to place the pivot established between the base support member and the mounting arm in a location approximately aligned with the hip joint of the user. In this way the quiver can be positioned so that it pivots around the hip joint and thus positions the quiver in an anatomical position relative to the body. Thus the mounting device for the quiver essentially rotates around the leg pivot so as to correspond with the movements of the leg. The overall total angular adjusting range for the mounting arm 14 can be as much as 275 degrees with respect to the base support member 12. In this way the quiver can be repositioned to any number of desired positions depending upon the activity of the user.

FIGS. 7A–7G show an example of the various positions that the quiver can be moved to during various maneuvers by the archer. These range from crawling on all fours, to running, to walking, stalking, stooping or kneeling. The present quiver mounting device greatly facilitates the ability of the archer to properly an quickly position the quiver and arrows during any one of these maneuvers.

The various parts making up the quiver mount as provided in the present invention can be manufactured from plastic or other inexpensive but strong, reliable materials. In addition to plastic the base support member and quiver mounting arm can be fabricated from not only plastic but lightweight metal or synthetic resins.

The overall design that is provided in this invention allows the components to be incorporated together in such fashion as to create a minimum number of required parts resulting in an archery accessory which is easily and inexpensively manufactured and assembled and which requires little if any maintenance. In addition, through the use of correctly chosen materials the mount can be extremely durable and light weight yet versatile. It is desirable to choose a material for the base support member which has the properties of high flexural strength and yet has lubricity. In this way the required frictional characteristics for the mount can be obtained. This allows the parts to easily move with respect to each other when the tension is properly adjusted. Of the number of materials that are available the preferred choice for the base support member is high density polyethylene. This material has an additional benefit in that it can be injection molded at a very low cost. The quiver mounting arm can be fabricated from a light weight metal such as aluminum to provide desirable rigidity and strength.

The improved archery mounting device as provided in the present invention creates an archery accessory which accepts numerous quiver models, mounts easily and securely right or left sided onto varying width waist belts or waistbands of an archer or bow hunter and allows the quiver to be rotated and held in an infinite number of positions, using the manual assistance of only one hand. This ability provides the archer or bow hunter with the ability to more easily adapt and remain concealed and camouflaged in changing terrain and surroundings as well as varying hunting, scouting, stalking and shooting conditions and situations.

While an improved quiver mounting device has been shown and described in detail in this application, it is to be understood that this invention is not to be limited to the exact form disclosed and changes in detail and construction of the various embodiments of the invention ma be made without departing from the spirit thereof.

What is claimed is:

1. An archery quiver mounting device for positioning a quiver and arrows so as to allow freedom of movement to the archer, the mounting device comprising:

a) a base support means including a mean for attaching the mounting device to the clothing of the archer;

b) a quiver mounting means for attachment of a quiver coupler device for mounting an archery quiver to the mounting device, said quiver mounting means includes an elongated mounting arm having first and second ends, said mounting arm having a plurality of properly spaced mounting holes near the second end for attaching a quiver coupler device;

c) said base support means including means for pivotally connecting the mounting means to the base support means, said pivotally connecting means on said base support means including a clevis having first and second bifurcated legs forming a slot therebetween for pivotally receiving the first end of said mounting arm between said legs; and d) said connecting means including adjusting means for adjusting the pivotal friction between the first and second legs and said mounting arm whereby the user can quickly position the quiver and arrows so as not to interfere with the archer's movements during use.

2. A mounting device as defined in claim 1, wherein one leg of the connecting means is integrally formed as part of the base support means.

3. A quiver mounting device as defined in claim 1, wherein the adjusting means includes a bolt and tension knob which is used to attach said mounting arm to said clevis and said tension knob is adapted to be adjusted by one hand whereby the pivotal friction between the legs and mounting arm can be varied by changing the tension of the bolt and the forces on the clevis to properly position and hold the quiver and arrows.

4. A quiver mounting device as defining in claim 1, wherein said base support means and connecting means is molded from high density polyethylene which provides lubricity in the pivotal connection between the support and mounting means.

5. A quiver mounting device as defined in claim 1, wherein the attaching means is one or more pairs of parallel slots which are properly sized and positioned so that the belt of the user can be passed through the slots to attach the mounting device to the user.

6. A quiver mounting device as defined in claim 1, wherein said mounting arm has an attaching means for attaching a quiver quick-disconnect coupler device so that the quiver can be attached and removed from the quiver mounting device as desired.

7. An archery quiver mounting device for easily mounting and positioning a quiver and arrows for use by an archer, the mounting device comprising:

a) a base support means having a relatively wide body section with an attaching means provided at one end of said support means for suitably attaching the base support means to the archer and a pivotal connecting means formed at the opposite end of the said support means;

b) a quiver mounting arm means which is a relatively elongated member, one end of said mounting arm means being arranged to pivotally connect to the pivotal connecting means of said base support means, said connecting means including a pair of bifurcated legs forming a slot therebetween and said one end of the mounting arm means is positioned within said slot, said pivotal connecting means including tension adjusting means for adjusting the pivotal friction forces between the pivotal connecting means and said mounting arm means whereby the mounting arm means can be pivotally positioned within a considerable angular range; and c) said mounting arm means including a plurality of threaded apertures properly spaced along the longitudinal axis of said mounting arm means and arranged near the end of said arm means from said pivotal attaching end, said threaded apertures being arranged to receive a quick-disconnect coupler device for connecting the quiver to the mounting arm means, said mounting arm means being bent in the area between said pivotal connect end and said quiver attaching end whereby the quiver attaching end of said mounting arm means and the attached quiver are angled inward towards the archer's body to keep the quiver close to the leg of the archer during movement.

8. A quiver mounting device as defined in claim 7, wherein the attaching means includes belt attaching means for attaching the base support means to a belt worn by the archer.

9. A mounting device as defined in claim 8, wherein said belt attaching means is a plurality of parallel closed slots positioned near an outer edge of the base support means whereby the belt of the user can be threaded through the slots to hold and position the mounting device near the hip of the user.

10. A mounting device as defined in claim 9, wherein the base support means has an approximate length between the belt attaching means and the mounting arm pivotal connection whereby the mounting arm pivot is positioned adjacent to a hip joint of the archer whereby the pivoting movement of said mounting arm essentially corresponds with the pivoting of the archer's leg.

11. A mounting device as defined in claim 7, wherein the mounting arm means is bent inward toward the archer within the range of 15 to 17 degrees.

12. A mounting device as defined in claim 7, wherein one leg of the connecting means is integrally formed as part of the base support means.

* * * * *